US011016440B2

(12) United States Patent
Kawamura et al.

(10) Patent No.: US 11,016,440 B2
(45) Date of Patent: May 25, 2021

(54) CARTRIDGE REPRODUCTION METHOD AND CARTRIDGE

(71) Applicant: CANON KABUSHIKI KAISHA, Tokyo (JP)

(72) Inventors: Tomofumi Kawamura, Suntou-gun (JP); Hiroki Shimizu, Suntou-gun (JP); Masato Tanabe, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/807,331

(22) Filed: Mar. 3, 2020

(65) Prior Publication Data

US 2020/0285192 A1 Sep. 10, 2020

(30) Foreign Application Priority Data

Mar. 5, 2019 (JP) ..... JP2019-039739

(51) Int. Cl.
*G03G 21/18* (2006.01)
*G03G 15/08* (2006.01)

(52) U.S. Cl.
CPC ..... *G03G 21/1871* (2013.01); *G03G 15/0863* (2013.01); *G03G 21/1885* (2013.01); *G03G 2215/0697* (2013.01); *G03G 2221/166* (2013.01)

(58) Field of Classification Search
CPC ..... G03G 15/0863; G03G 21/1676; G03G 21/181; G03G 21/1871; G03G 21/1875; G03G 21/1878; G03G 21/1885; G03G 2215/0697; G03G 2221/166; G03G 2221/1823
See application file for complete search history.

(56) References Cited

U.S. PATENT DOCUMENTS 7,424,245 B2 * 9/2008 Burchette ..... G03G 21/181 399/107
7,689,144 B2 * 3/2010 Martin ..... G03G 15/0863 399/109
2002/0018658 A1 2/2002 Sakai et al.
(Continued)

FOREIGN PATENT DOCUMENTS

JP 2003-330335 A 11/2003

OTHER PUBLICATIONS

Co-pending U.S. Appl. No. 16/858,822, filed Apr. 27, 2020.
Co-pending U.S. Appl. No. 16/893,788, filed Jun. 5, 2020.

*Primary Examiner* — Sophia S Chen
(74) *Attorney, Agent, or Firm* — Venable LLP

(57) ABSTRACT

A material cartridge includes a first unit including a first attachment portion, a second unit and a first memory unit. The first memory unit that is attached to the first attachment portion and includes a first electrode and a first storage element. A cartridge reproduction method includes: detaching the first memory unit from the first attachment portion; attaching an electrode unit to the first attachment portion, the electrode unit including a second electrode, the second electrode configured to be brought into contact with a main body electrode of an image forming apparatus so as to be electrically connected to the main body electrode; and attaching, to the first unit, an element unit including a second storage element configured to be electrically connected to the second electrode. The element unit is located in a gap formed between the first unit and the second unit.

20 Claims, 13 Drawing Sheets

(56) References Cited

U.S. PATENT DOCUMENTS

| | | | | |
|---|---|---|---|---|
| 2002/0041767 | A1 | 4/2002 | Saito et al. | |
| 2003/0215261 | A1 | 11/2003 | Karakama et al. | |
| 2008/0159774 | A1 | 7/2008 | Tanabe et al. | |
| 2008/0253803 | A1 | 10/2008 | Nittani et al. | |
| 2010/0142996 | A1 | 6/2010 | Tanabe et al. | |
| 2010/0158563 | A1 | 6/2010 | Tanabe et al. | |
| 2011/0206412 | A1 | 8/2011 | Tanabe et al. | |
| 2013/0223853 | A1 | 8/2013 | Chadani et al. | |
| 2014/0086597 | A1* | 3/2014 | Tanabe ..... | G03G 21/1878 399/12 |
| 2014/0169829 | A1 | 6/2014 | Maeshima et al. | |
| 2014/0212181 | A1 | 7/2014 | Nakamura et al. | |
| 2015/0277370 | A1 | 10/2015 | Maeshima et al. | |
| 2016/0018784 | A1 | 1/2016 | Maeshima et al. | |
| 2016/0238993 | A1* | 8/2016 | Kanno ..... | G03G 21/1885 |
| 2017/0082971 | A1 | 3/2017 | Maeshima et al. | |
| 2017/0248869 | A1 | 8/2017 | Matsumoto et al. | |
| 2017/0248905 | A1 | 8/2017 | Anan et al. | |
| 2017/0261917 | A1 | 9/2017 | Harada et al. | |
| 2018/0188683 | A1 | 7/2018 | Maeshima et al. | |
| 2018/0329359 | A1 | 11/2018 | Anan et al. | |
| 2019/0121285 | A1 | 4/2019 | Maeshima et al. | |
| 2019/0187608 | A1 | 6/2019 | Uesugi et al. | |
| 2020/0073286 | A1 | 3/2020 | Takeuchi et al. | |
| 2020/0285191 | A1* | 9/2020 | Shimizu ..... | G03G 21/1839 |

* cited by examiner

CARTRIDGE REPRODUCTION METHOD AND CARTRIDGE

BACKGROUND OF THE INVENTION

Field of the Invention

The present invention relates to a cartridge used for such an imaging forming apparatus as a copier, a printer and a facsimile, and a cartridge reproduction method.

Description of the Related Art

In an image forming apparatus of an electrophotographic image forming system (electrophotographic process), an electrophotographic photosensitive member (hereinafter, referred to as "photosensitive member"), which is an image bearing member, is uniformly charged. An electrostatic latent image is then formed on the photosensitive member by selectively exposing the charged photosensitive member. The electrostatic latent image formed on the photosensitive member is developed as a toner image using toner (developer). The toner image formed on the photosensitive member is transferred to a recording material (e.g. recording paper, plastic sheet). The toner image transferred on the recording material is then heated and pressed, so as to fix the toner image to the recording material, whereby the image is recorded.

This kind of image forming apparatus generally requires maintenance of various processing units. For practical reasons, to simplify the maintenance of these various processing units, the photosensitive member, charging unit, developing unit, cleaning unit and the like are integrated in a frame as a cartridge, which is attachable to and detachable from the image forming apparatus main body. This cartridge system can provide an image forming apparatus that excels in usability.

For the cartridge, a drum cartridge which includes a photosensitive drum (photosensitive member), a developing cartridge including a developing unit, a toner cartridge which supplies developer are known.

Japanese Patent Application Publication No. 2003-330335 discloses a product where a cartridge includes a memory unit (recording unit) that records various service information and process information. By utilizing the information recorded in the memory portion, the image forming apparatus further improves the image quality and maintenance of the cartridge.

In the case of such a cartridge, toner and each component are consumed by forming images. The cartridge reaches the end of the lifetime when an image having quality that satisfies the user who purchased the cartridge can no longer be formed.

Recently a method of recycling a cartridge, which ended the lifetime and lost its product value, has been proposed. As a method of reproducing such a cartridge, a method of removing the memory unit attached to the cartridge and attaching a new memory unit is under consideration.

SUMMARY OF THE INVENTION

However, the shape and size of the memory unit may be different depending on the product. The shape of the portion to which the memory unit is attached may be different as well. This means that a memory unit, which corresponds to the shape of the portion to attach the memory unit in the cartridge, must be provided.

Further, cartridges have been downsized recently as the image forming apparatus becomes smaller. Therefore, the shape and size of a memory unit that is attachable to a cartridge are limited. With the foregoing in view, it is an object of the present invention to provide a reproduction method of a cartridge in which a first memory unit, that is attached to a cartridge before the reproduction, can be replaced with a second memory unit of which shape and size are different from those of the first memory unit.

In order to achieve the object described above, a cartridge reproduction method for reproducing a cartridge from a material cartridge that is attachable to and detachable from an image forming apparatus including a main body electrode, wherein the material cartridge includes:

a first unit including a first attachment portion;

a first memory unit attached to the first attachment portion, the first memory unit including a first electrode and a first storage element for storing information, the first electrode configured to be brought into contact with the main body electrode so as to be electrically connected to the main body electrode, and the first storage element electrically connected to the first electrode; and a second unit that is joined to the first unit, the cartridge reproduction method comprising:

detaching the first memory unit from the first attachment portion;

attaching an electrode unit to the first attachment portion, the electrode unit including a second electrode, the second electrode configured to be brought into contact with the main body electrode so as to be electrically connected to the main body electrode; and attaching an element unit including a second storage element for storing information to the first unit so that the element unit is located in a gap formed between the first unit and the second unit, wherein the second electrode and the second storage element being electrically connected via a connecting member.

In order to achieve the object described above, a cartridge that is attachable to and detachable from an image forming apparatus including a main body electrode, including:

a first unit including a first attachment portion;

a second unit that is joined to the first unit;

an electrode unit attached to the first attachment portion and including a cartridge electrode, the cartridge electrode configured to be brought into contact with the main body electrode so as to be electrically connected to the main body electrode; and an element unit including a storage element, the storage element electrically connected to the cartridge electrode, wherein the element unit is attached to the first unit so as to be located in a gap formed between the first unit and the second unit.

Further features of the present invention will become apparent from the following description of exemplary embodiments with reference to the attached drawings.

DESCRIPTION OF THE EMBODIMENTS

An embodiment of the present invention will be described as an example with reference to the drawings. Dimensions, materials and shapes of the components and relative positions thereof described in the embodiments may be appropriately changed depending on the configuration and various conditions of the apparatus to which the invention is applied. In other words, the following description is not intended to limit the scope of this invention to the following embodiments.

The present invention relates to an image forming apparatus using the electrophotographic system (electrophotographic image forming apparatus), and a developing device and cartridge which are used for this electrophotographic image forming apparatus. Here the electrophotographic image forming apparatus is an apparatus that forms an image on a recording material (recording medium) using the electrophotographic image forming process. Examples of the electrophotographic image forming apparatus include, a printer (e.g. laser beam printer, LED printer), copier, facsimile, word processor and composite machine thereof (multifunction printer). The developing device is a device that develops an electrostatic latent image, which is formed on the electrophotographic photosensitive drum, using developer, and is constituted of a developing unit, a developing frame that supports the developing unit, and components related to the developing unit. Examples of the developing unit are a developing roller, a coating roller, and a developing blade.

General Configuration of Image Forming Apparatus

Figure 2:
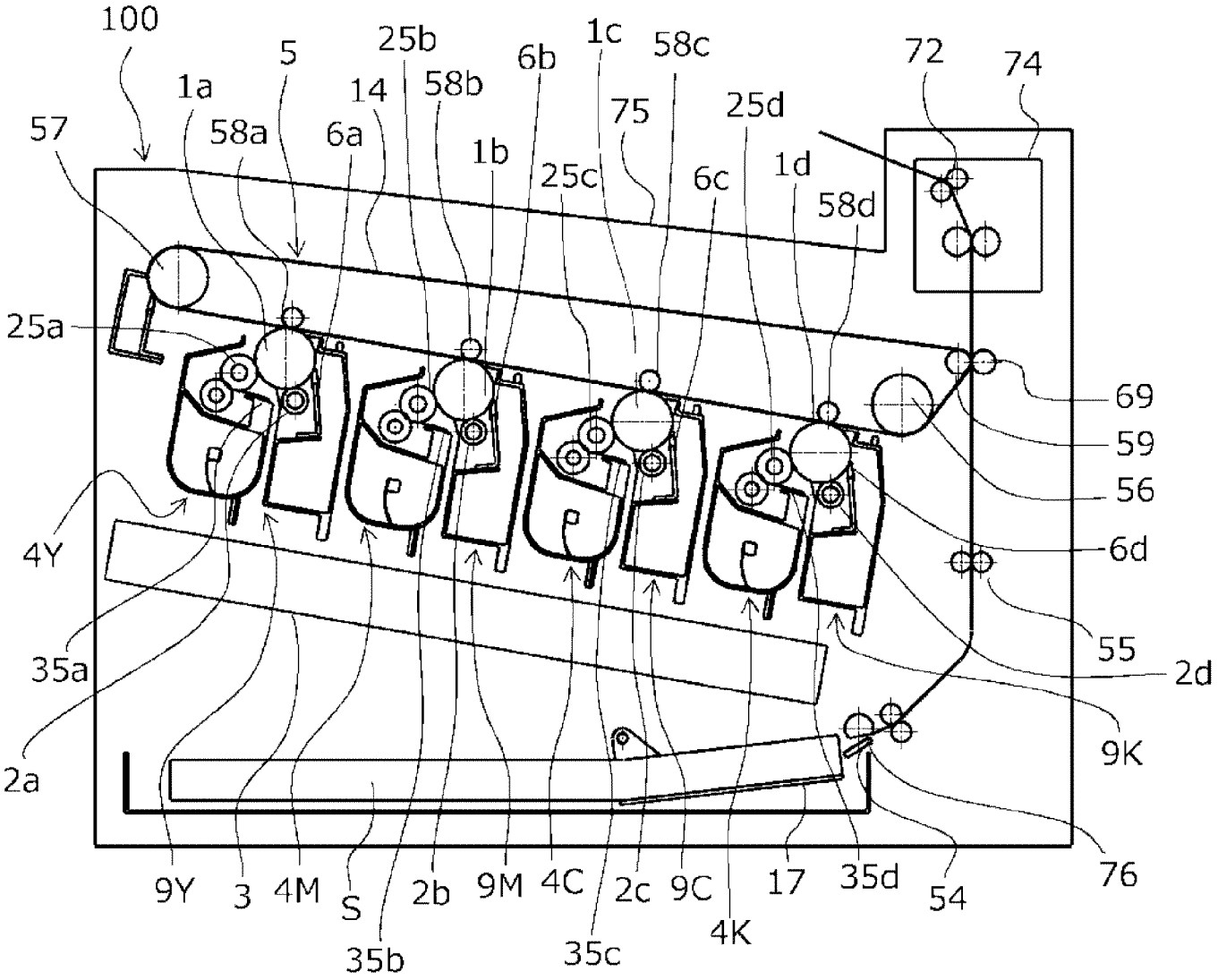
FIG. 2 is a schematic cross-sectional view of an image forming apparatus.

General configuration of the electrophotographic image forming apparatus (hereinafter, referred to as "image forming apparatus") 100 will be described with reference to FIG. 2. FIG. 2 is a schematic cross-sectional view of the image forming apparatus 100. As illustrated in FIG. 2, in the image forming apparatus 100, four image bearing member cartridges (hereinafter, referred to as "drum cartridge") 9 (9Y, 9M, 9C, 9K), which are attachable to and detachable from the image forming apparatus 100, are attached via an attaching member (not illustrated). Further, four developing devices (hereinafter, referred to as "developing cartridges") 4 (4Y, 4M, 4C, 4K), which are attachable to and detachable from the image forming apparatus 100, are attached in the image forming apparatus 100 via the attaching member (not illustrated). In this embodiment, the configuration and operation of each drum cartridge 9, and the configuration and operation of each developing cartridge 4 are also substantially identical, except that a color of the image to be formed is different. Therefore, unless specific distinction is necessary, the drum cartridges 9 and the developing cartridges 4 will be described in general, omitting Y, M, C and K. In this embodiment, the phrase "each drum cartridge 9" refers to each drum cartridge 9Y, 9M, 9C and 9K, and "each developing cartridge 4" refers to each developing cartridge 4Y, 4M, 4C and 4K. The upstream side of the attaching direction when the drum cartridge 9 and the developing cartridge 4 are attached in the image forming apparatus 100 is defined as the front side, and the downstream side of the attaching direction is defined as the rear side. In FIG. 2, in the image forming apparatus 100, the drum cartridge 9 and the developing cartridge 4 are disposed side by side in an inclined state with respect to the horizontal direction.

The image forming apparatus 100 includes electrophotographic photosensitive drums (hereinafter, referred to as "photosensitive drums") 1 (1*a*, 1*b*, 1*c*, 1*d*), which are rotating members, charging rollers 2 (2*a*, 2*b*, 2*c*, 2*d*) and cleaning members 6 (6*a*, 6*b*, 6*c*, 6*d*). In this embodiment, the phrase "each photosensitive drum 1" refers to each of the photosensitive drums 1*a*, 1*b*, 1*c* and 1*d*. This is the same for other composing elements, such as the charging rollers 2*a*, 2*b*, 2*c* and 2*d*. In each drum cartridge 9, each process unit, such as each charring roller 2 and each cleaning member 6, is integrally disposed around each photosensitive drum 1.

The image forming apparatus 100 also includes developing rollers 25 (25*a*, 25*b*, 25*c*, 25*d*) and developing blades 35 (35*a*, 35*b*, 35*c*, 35*d*). In each developing cartridge 4, each process unit, such as each developing roller 25 and each developing blade 35, is integrally disposed.

The charging roller 2 uniformly charges the surface of the photosensitive drum 1. The developing roller 25 (developer bearing member) develops an electrostatic latent image formed on the photosensitive drum 1 using developer (hereinafter, referred to as "toner"), so as to be visible, and forms a toner image on the photosensitive drum 1. The cleaning member 6 removes toner remaining on the photosensitive drum 1 after transferring the toner image formed on the photosensitive drum 1 to a recording medium S.

Below the drum cartridge 9 and the developing cartridge 4, a scanner unit 3, which selectively exposes the photosensitive drum 1 based on the image information and forms an electrostatic latent image on the photosensitive drum 1, is disposed.

In the lower part of the image forming apparatus 100, a cassette 17 storing the recording medium S is attached. Further, a recording medium transporting unit is disposed in the image forming apparatus 100 so that the recording medium S is transported to the upper part of the image forming apparatus 100, passing a secondary transfer roller 69 and a fixing unit 74. In other words, in the image forming apparatus 100, a paper feeding roller 54 which separates and feeds the recording medium S in the cassette 17 one by one at a time, a transporting roller pair 76 which transports the recording medium S that is fed, and a resist roller pair 55 to synchronize the electrostatic latent image on the photosensitive drum 1 and the recording medium S are disposed. An intermediate transfer unit 5, which is an intermediate transfer unit to transfer a toner image formed on each photosensitive drum 1, is disposed above the drum cartridge 9 and the developing cartridge 4. The intermediate transfer unit 5 includes a driver roller 56, a driven roller 57, primary transfer rollers 58 (58*a*, 58*b*, 58*c* 58*d*) disposed at positions facing each photosensitive drum 1 of each color, and a counter roller 59 which is disposed at a position facing the secondary transfer roller 69. A transfer belt 14 passes around the driver roller 56, the driven roller 57, the primary transfer roller 58 and the secondary transfer roller 69. In the transfer belt 14, voltage is applied to each primary transfer roller 58, which circulates in a state of facing and contacting each photosensitive drum 1, whereby the primary transfer is performed from the photosensitive drum 1 onto the transfer belt 14. The toner on the transfer belt 14 is then transferred to the recording medium S when voltage is applied to the counter roller 59, which is disposed inside the transfer belt 14, and the secondary transfer roller 69.

Image Forming Process

When an image is formed, each photosensitive drum 1 is rotated and is uniformly charged by the charging roller 2. The charged photosensitive drum 1 is then selectively exposed by the laser light emitted from the scanner unit 3. An electrostatic latent image is thereby formed on the photosensitive drum 1. The electrostatic latent image formed on the photosensitive drum 1 is then developed by the developing roller 25. A toner image of each color is thereby formed on each photosensitive drum 1. Synchronizing with this image formation, the resist roller pair 55 transports the recording medium S to the secondary transfer position where the counter roller 59 and the secondary transfer roller 69 face each other via the transfer belt 14. The toner image of each color of the transfer belt 14 is then secondarily transferred to the recording medium S by applying transfer bias voltage to the secondary transfer roller 69. The toner image of each color (color image) is thereby formed on the recording medium S. The recording medium S, on which the toner image of each color is formed, is heated and pressed by the fixing unit 74, whereby the toner image of each color is fixed. The recording medium S is then discharged to a discharging unit 75 by a discharging roller 72. The fixing unit 74 is disposed in an upper part of the image forming apparatus 100.

Drum Cartridge

Figure 3:
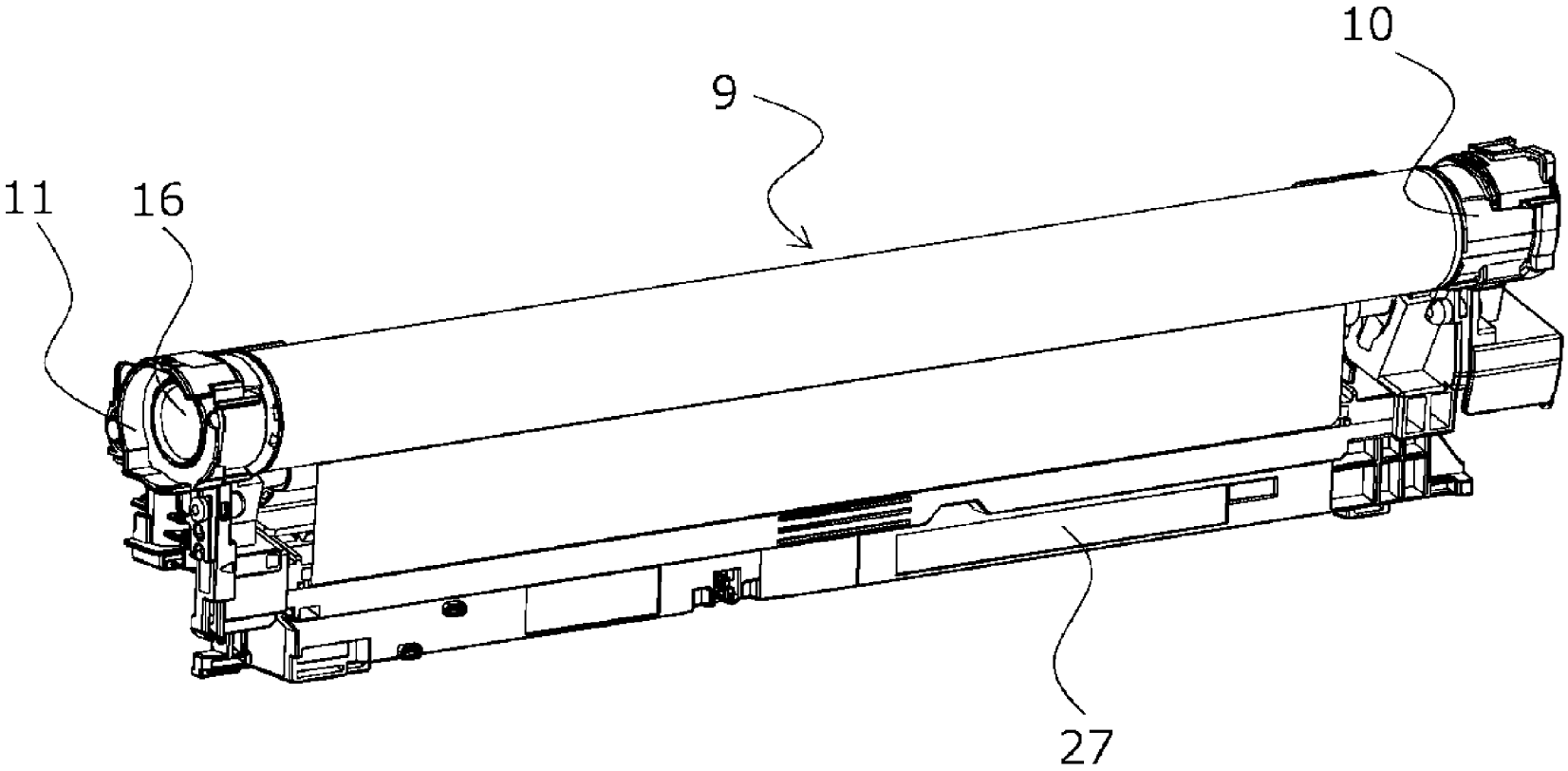
FIG. 3 is a schematic perspective view of a drum cartridge.

The drum cartridge 9 will be described next with reference to FIG. 3 and FIG. 4. FIG. 3 is a schematic perspective view of the drum cartridge 9 (9Y, 9M, 9C, 9K). The drum cartridges 9Y, 9M, 9C and 9K have the same configuration. In this embodiment, the upstream side of the inserting direction, when the drum cartridge 9 and the developing cartridge 4 are inserted into the apparatus main body of the image forming apparatus 100, is defined as the front side, and the downstream side of the inserting direction is defined as the rear side.

In a drum frame 27 of the drum cartridge 9, the photosensitive drum 1 is rotatably disposed via a second drum bearing 10 and a first drum bearing 11. Thus, the drum frame 27 rotatably supports the photosensitive drum 1. The first drum bearing 11 and the second drum bearing 10 may be regarded as a part of the drum frame 27. In other words, the drum frame 27 supports the photosensitive drum 1 such that the photosensitive drum 1 can rotate. A drum coupling 16 and a flange are disposed on one end of the photosensitive drum 1 in the rotation axis direction of the photosensitive drum 1.

Figure 4:
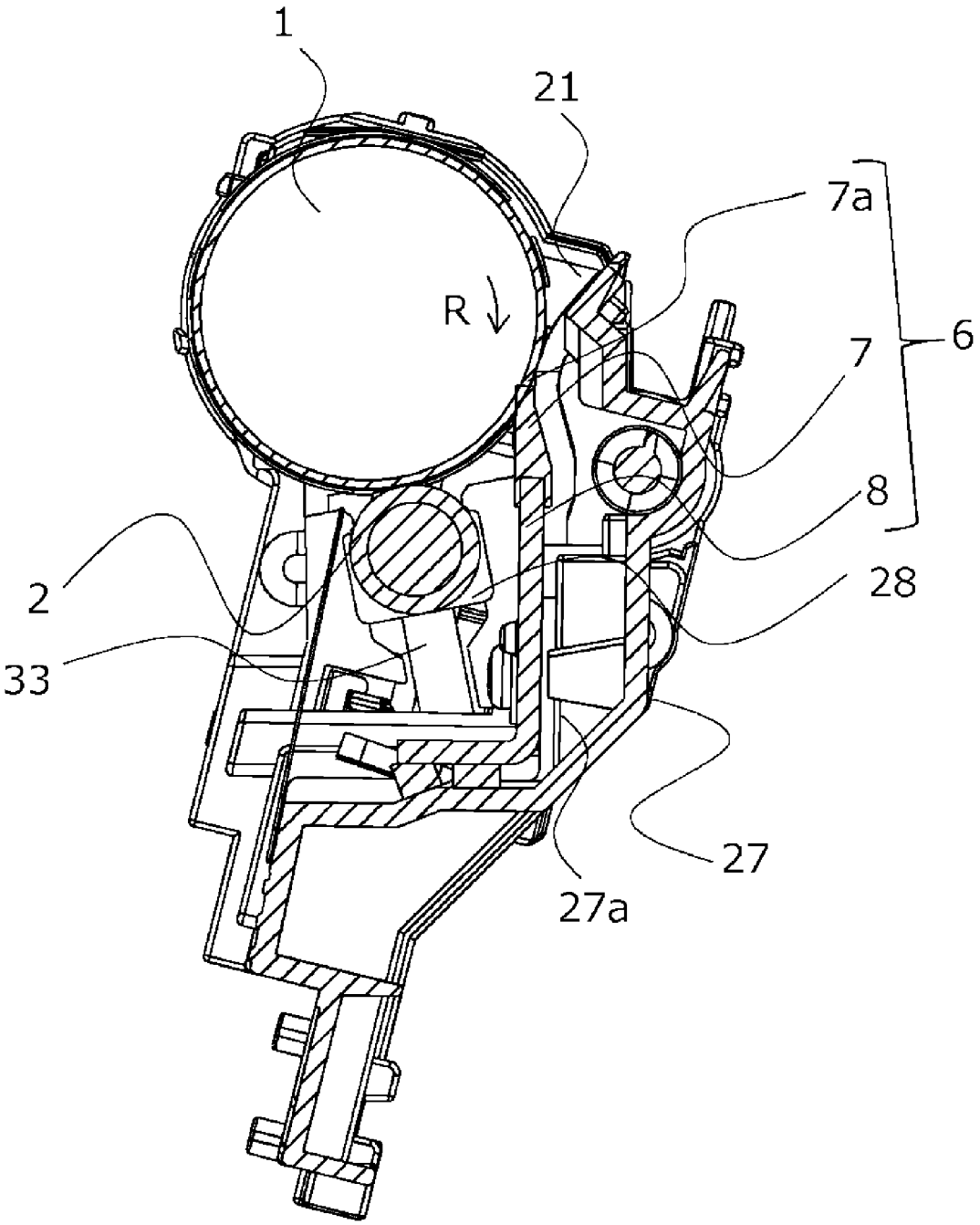
FIG. 4 is a cross-sectional view of the drum cartridge.

FIG. 4 is a cross-sectional view of the drum cartridge 9. The charging roller 2 and the cleaning member 6 are disposed around the photosensitive drum 1. The cleaning member 6 is constituted of an elastic member 7 which is formed on a rubber blade, and a cleaning support member 8. A front edge 7*a* of the elastic member 7 is disposed so as to contact the photosensitive drum 1 in the counter direction of the rotating direction R of the photosensitive drum 1. Residual toner removed from the surface of the photosensitive drum 1 by the cleaning member 6 drops into a removed toner chamber 27*a*. Further, a scoop sheet 21, to prevent the leakage of the removed toner from the removed toner chamber 27*a*, contacts the photosensitive drum 1. The photosensitive drum 1 is then rotary-driven in accordance with the image forming operation by transferring the drive force of the main drive motor (not illustrated), which is a drive source, to the drum cartridge 9. The charging roller 2 is rotatably attached in the drum cartridge 9 via the charging roller bearing 28, so as to be pressed toward the photosensitive drum 1 by a charging roller pressing member 33, and rotate in accordance with the photosensitive drum 1.

Developing Cartridge

Figure 5:
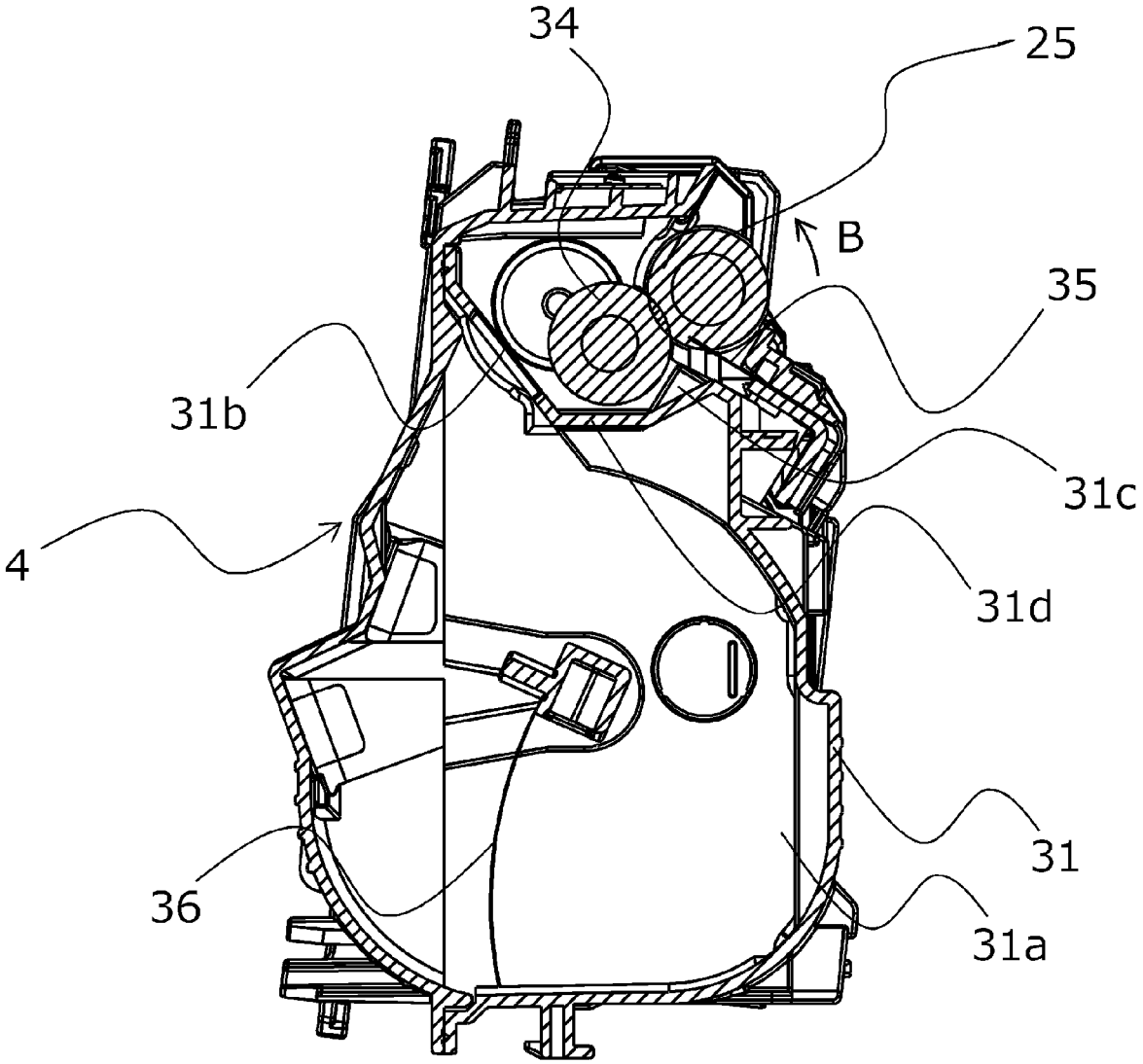
FIG. 5 is a cross-sectional view of a developing cartridge.

The developing cartridge 4 will be described next with reference to FIG. 5 and FIG. 7. FIG. 5 is a cross-sectional view of the developing cartridge 4 (4Y, 4M, 4C, 4K) in which toner is stored. The developing cartridges 4Y, 4M, 4C and 4K have the same configuration.

Figure 7:
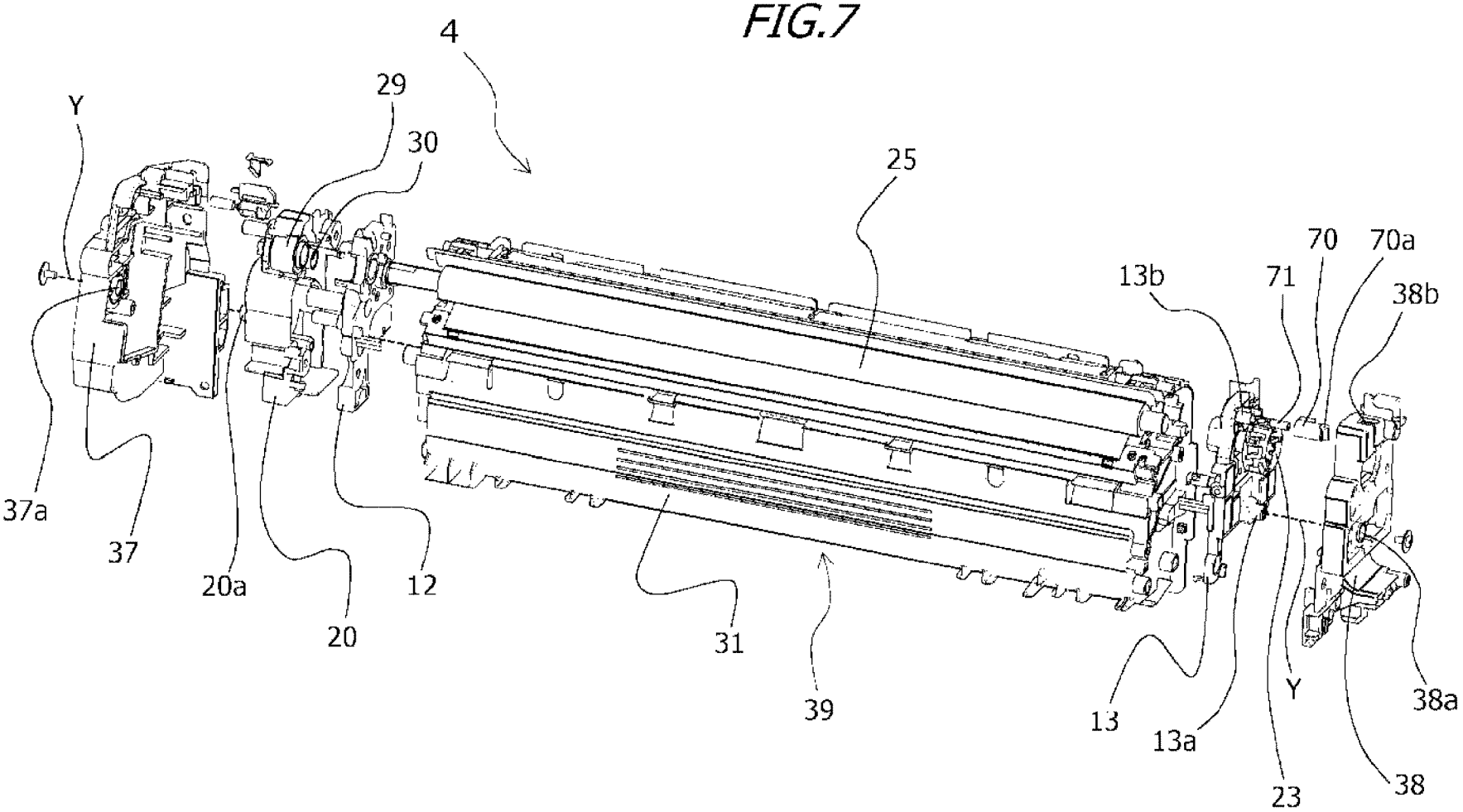
FIG. 7 is a schematic perspective view of the developing cartridge.

FIG. 7 is a schematic perspective view of the developing cartridge 4. The developing cartridge 4Y in which yellow toner is stored, the developing cartridge 4M in which magenta toner is stored, the developing cartridge 4C in which cyan toner is stored, and the developing cartridge 4K in which black toner is stored have the same configuration.

The developing cartridge 4 includes the developing roller 25 that bears toner, a toner supply roller 34 that supplies toner to the developing roller 25, the developing blade 35, a toner transporting member 36, and a developing frame 31 that supports these components. A unit constituted of the developing roller 25, the toner supply roller 34, the developing blade 35, the toner transporting member 36 and the developing frame 31 is called a developing unit 39. The developing roller 25 is a rotating member (first rotating member) that contacts the photosensitive drum 1 and rotates in the arrow B direction. The toner supply roller 34 rotates contacting the developing roller 25. The developing blade 35 regulates the thickness of the toner layer on the developing roller 25. The toner transporting member 36 transports the toner.

The developing frame (first frame) 31 supports the developing roller 25 so that the developing roller 25 can rotate. The developing frame 31 is constituted of a developing chamber 31*c* in which the developing roller 25 is disposed, and a toner storing chamber 31*a* which is disposed below the developing chamber 31*c*. The developing chamber 31*c* and the toner storing chamber 31*a* are separated by a partition wall 31*d*. In the partition wall 31*d*, an opening 31*b*, where toner passes when the toner is transported from the toner storing chamber 31*a* to the developing chamber 31*c*, is disposed.

In the toner storing chamber 31*a* of the developing frame 31, the toner transporting member 36, which stirs the stored toner and transports the toner to the developing chamber 31*c* via the opening 31*b*, is disposed. As illustrated in FIG. 7, the developing roller 25 and the toner supply roller 34 (not illustrated in FIG. 7) are rotatably supported by a first developing bearing 13 and a second developing bearing 12, which are attached on the edges of the developing frame 31 in the rotation axis direction of the developing roller 25. The first developing bearing 13 and the second developing bearing 12 may be regarded as a part of the developing frame 31. In other words, the developing frame 31 supports the developing roller 25 so that the developing roller 25 can rotate. A developing coupling 23 is disposed on the rear side edge of the toner supply roller 34. A toner supply gear 30 is disposed on the front side edge of the toner supply roller 34. Further, a developing gear 29, which engages with the toner supply gear 30, is disposed on the front side edge of the developing roller 25. Using this configuration, the drive force of a main body drive motor (not illustrated), which is a drive source, is transferred to the developing coupling 23, whereby the toner supply roller 34 and the developing roller 25 are rotary-driven in accordance with the image forming operation. Further, a gear cover 20 is disposed as a part of the developing frame 31 on the outer side of the developing gear 29 and the toner supply gear 30. A suspension hole 37*a*, which engages with a boss 20*a* formed on the gear cover 20, is disposed on a second end member 37.

A first end member (end member) 38 and the second end member 37 are attached on both edges of the developing frame 31 in the rotation axis direction of the developing roller 25. The second end member 37 is attached on the gear cover 20. The second end member 37 is disposed on the outer side of the second developing bearing 12 with respect to the developing frame 31 in the rotation axis direction of the developing roller 25. The first end member 38 is attached on the first developing bearing 13. The first end member 38 is disposed on the outer side of the first developing bearing 13 with respect to the developing frame 31 in the rotation axis direction of the developing roller 25. A suspension hole 38*a*, which engages with a boss 13*a* formed on the first developing bearing 13, is disposed on the first end member 38. The boss 13*a* protrudes toward the first end member 38. The boss 13*a* is an example of an engaging portion. The suspension hole 38*a* is an example of the engaged portion. Here the first end member 38 is a part of the first unit.

A rear side restriction member 70, which restricts rotation of the first end member 38 relative to the first developing bearing 13, is attached on the first developing bearing 13. The rear side restriction member 70 is a protrusion (projecting portion) which extends in a direction where the developing cartridge 4 is attached to the image forming apparatus 100 when the developing cartridge 4 is set in a position to be attached to or detached from the image forming apparatus 100. The rear side restriction member 70 can be moved in the direction where the developing cartridge 4 (developing device) is attached to or detached from the image forming apparatus 100. A restriction spring 71 (biasing member) is attached inside the rear side restriction member 70, at a spring support portion 13*b* of the first developing bearing 13. When the developing cartridge 4 is in a position to be attached to or detached from the image forming apparatus 100, the restriction spring 71 presses the rear side restriction member 70 in a direction where the developing cartridge 4 is attached to the image forming apparatus 100. A groove portion 38*b*, which can be engaged with the restriction portion 70*a* in the rear side restriction member 70, is disposed in the first end member 38. The groove portion 38*b* penetrates the first end member 38 in the direction where the developing cartridge 4 is attached to or detached from the image forming apparatus 100.

The second end member 37 and the first end member 38 are attached so as to be pivotable (rotatable) around a rotation axis (unit axis) Y connecting the boss 13*a* of the first developing bearing 13 and the boss 20*a* of the gear cover 20. In other words, the developing unit (second unit) 39 is movably joined to the first end member 38 and the second end member 37. Further, the developing unit 39 is pivotable around the rotation axis Y, relative to the second end member 37 and the first end member 38. The second end member 37 and the first end member 38 can be thereby independently rotated relative to the developing frame 31. In other words, the second end member 37 can rotate independently from the developing frame 31 and the first end member 38. The first end member 38 can be rotated independently from the developing frame 31 and the second end member 37. The rotation axis Y of the developing unit (second unit) 39 is parallel with the rotation axis of the developing roller 25. In this embodiment, the developing unit 39 has the developing frame 31, including the first developing bearing 13 which engages with the first end member 38, and the gear cover 20 and the second developing bearing 12 which engage with the second end member 37. Because of this configuration of the developing frame 31, the developing unit 39 can rotate with respect to the second end member 37 and the first end member 38. The second end member 37 and the first end member 38 support each edge of the developing unit 39 in the rotation axis direction of the developing roller 25.

Figure 6:
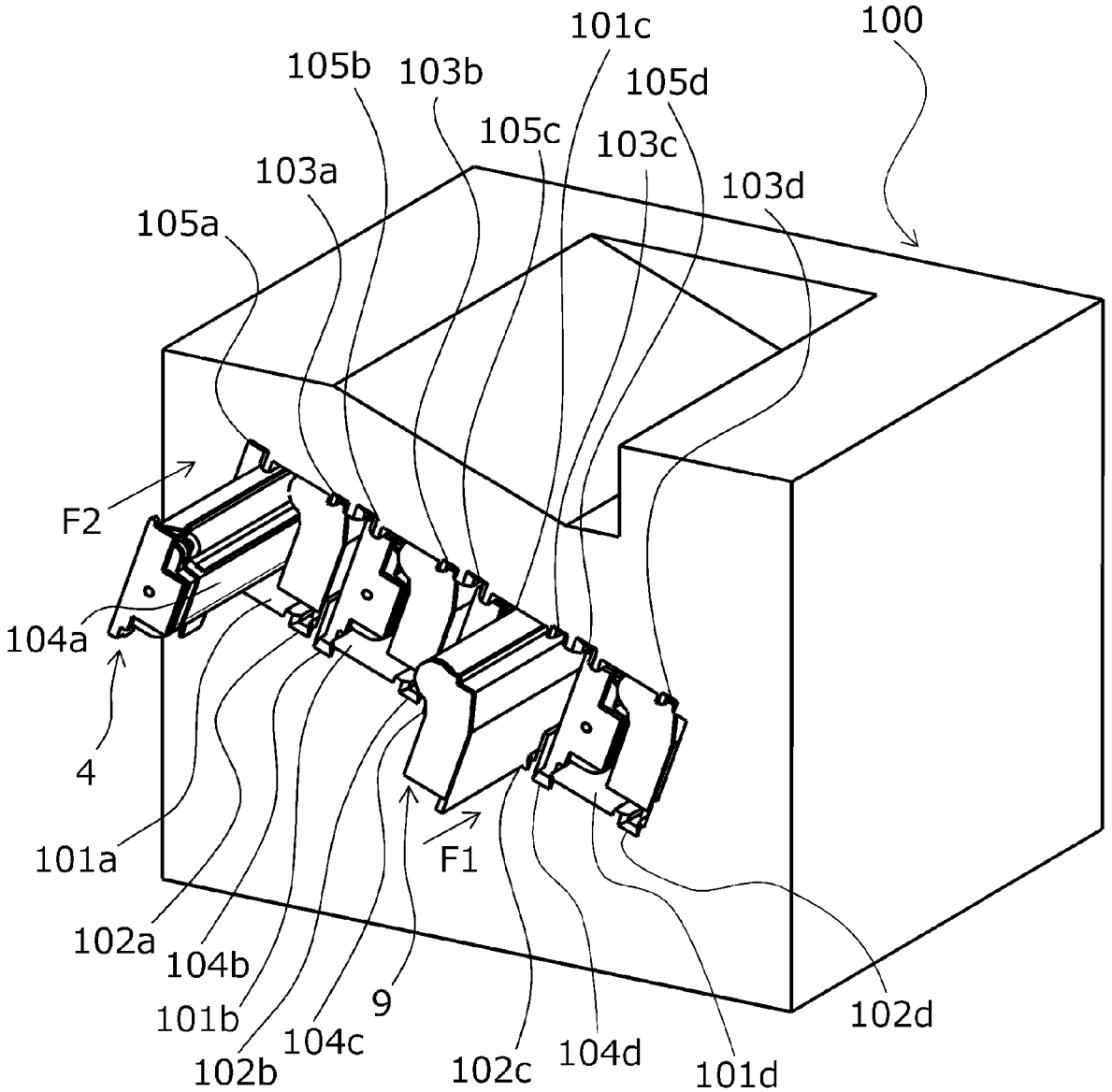
FIG. 6 is a diagram depicting the insertion of the cartridge into the image forming apparatus.

Configuration to Insert and Attach Drum Cartridge and Developing Cartridge in Image Forming Apparatus A configuration to insert the drum cartridge 9 and the developing cartridge 4 into the main body of the image forming apparatus 100 will be described next with reference to FIG. 6. The drum cartridge 9 (9Y, 9M, 9C, 9K) and the developing cartridge 4 (4Y, 4M, 4C, 4K) can be inserted into the opening 101 (101*a*, 101*b*, 101*c*, 101*d*) of the main body of the image forming apparatus 100. In the direction parallel with the rotation axis of the photosensitive drum 1 (arrow F1 direction in FIG. 6), the drum cartridge 9 is inserted into the main body of the image forming apparatus 100 from the front side to the rear side. In this case, the second drum bearing 10 is located at the upstream side of the drum frame 27 in the inserting direction of the drum cartridge 9, and the first drum bearing 11 is located at the downstream side of the drum frame 27 in the inserting direction of the drum cartridge 9. In the direction parallel with the rotation axis of the developing roller 25 (arrow F2 direction in FIG. 6), the developing cartridge 4 is inserted into the main body of the image forming apparatus 100 from the front side to the rear side. In this case, the second developing bearing 12 and the second end member 37 are located at the upstream side of the developing frame 31 in the inserting direction of the developing cartridge 4, and the first developing bearing 13 and the first end member 38 are located at the downstream side of the developing frame 31 in the inserting direction of the developing cartridge 4.

An upper guide portion 103 (103*a*, 103*b*, 103*c*, 103*d*), which is a first main body guide portion, is formed on the upper side of each opening 101. A lower guide portion 102 (102*a*, 102*b*, 102*c* 102*d*), which is a second main body guide portion, is formed on the lower side of each opening 101. The upper guide portion 103 and the lower guide portion 102 have guide shapes respectively, which extend in the inserting direction of the drum cartridge 9 (arrow F1 direction in FIG. 6). The upper guide portion 103 and the lower guide portion 102 have a groove shape (concave shape), for example. In the case of inserting the drum cartridge 9 into the main body of the image forming apparatus 100, first the drum cartridge 9 is placed on the front side of the lower guide portion 102. The drum cartridge 9 is then moved in the inserting direction of the drum cartridge 9 (arrow F1 direction in FIG. 6) along the upper guide portion 103 and the lower guide portion 102. In this way, the drum cartridge 9 is inserted into the main body of the image forming apparatus 100.

Further, an upper guide portion 105 (105*a*, 105*b*, 105*c*, 105*d*), which is a third main body guide portion, is formed on the upper side of each opening 101. A lower guide portion 104 (104*a*, 104*b*, 104*c*, 104*d*), which is a fourth main body guide portion, is formed on the lower side of each opening 101. The upper guide portion 105 and the lower guide portion 104 have guide shapes respectively, which extend in the inserting direction of the developing cartridge 4 (arrow F2 direction in FIG. 6). The upper guide portion 105 and the lower guide portion 104 have a groove shape (concave shape), for example. In the case of inserting the developing cartridge 4 into the main body of the image forming apparatus 100 as well, the procedure is the same as the case of the drum cartridge 9. First, the developing cartridge 4 is placed on the front side of the lower guide portion 104. The developing cartridge 4 is then moved in the inserting direction of the developing cartridge 4 (arrow F2 direction in FIG. 6) along the upper guide portion 105 and the lower guide portion 104. In this way, the developing cartridge 4 is inserted into the main body of the image forming apparatus 100.

Disposition of Storage Member

A storage member 60 is provided in the cartridge. Here a case of attaching the storage member 60 in the developing cartridge 4 (an example of a cartridge) will be described as an example.

Figure 8A:
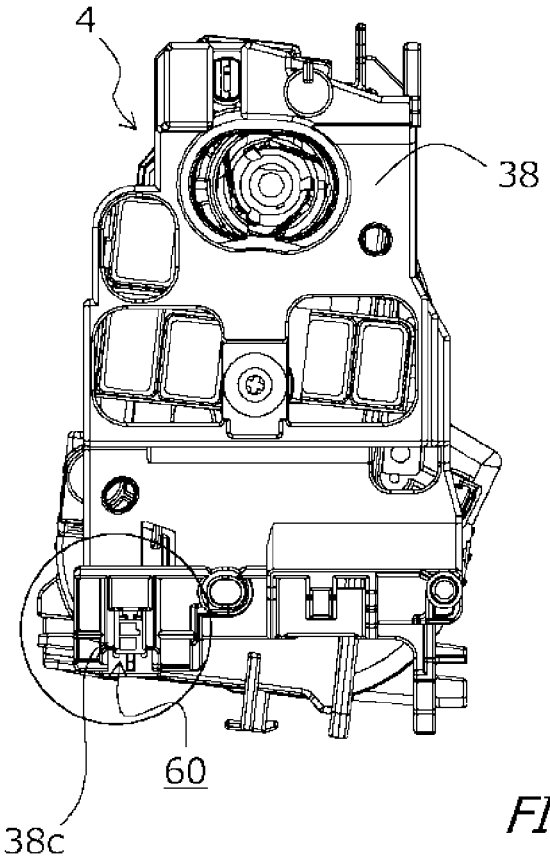
FIGS. 8A to 8C are schematic diagrams depicting the disposition of a storage member.
Figure 8B:
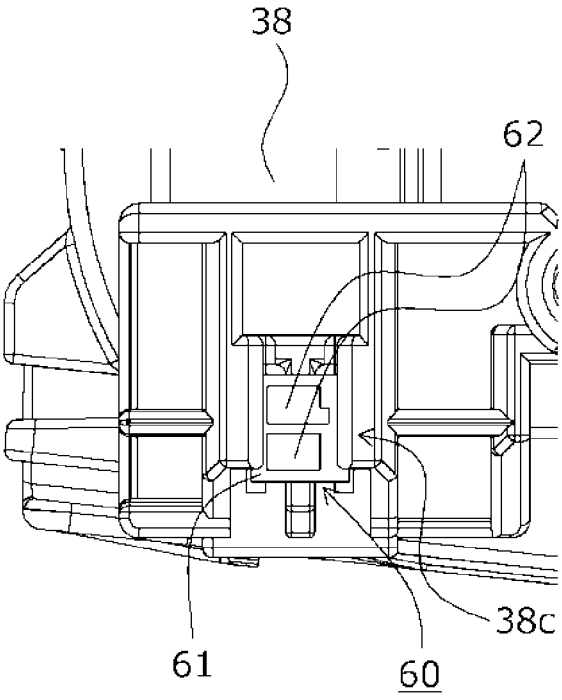
Figure 8C:
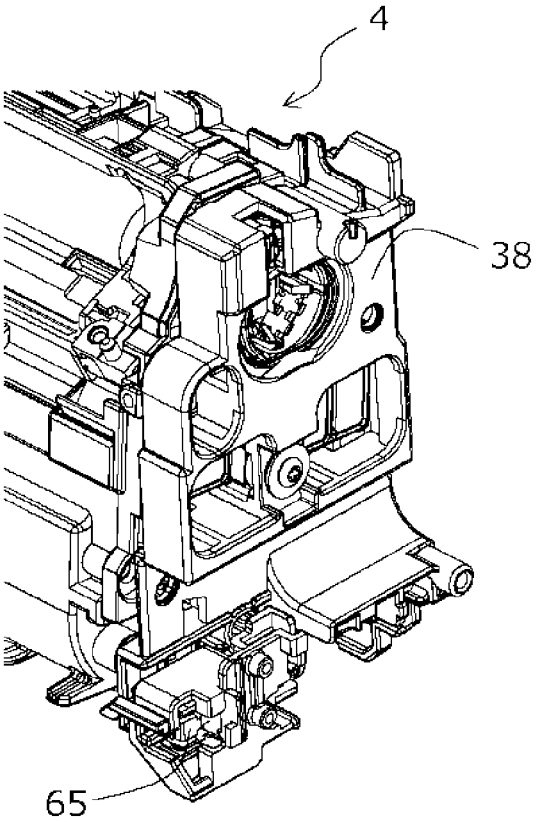

FIGS. 8A to 8C are schematic diagrams depicting a disposition of the storage member 60. FIG. 8A is a diagram of the developing cartridge 4 viewed from the rear side. FIG. 8B is a detailed diagram of an area around the storage member 60. FIG. 8C is a perspective view of the developing cartridge 4. FIG. 8C indicates a state where the developing cartridge 4 is attached in the apparatus main body of the image forming apparatus 100.

Figure 9A:
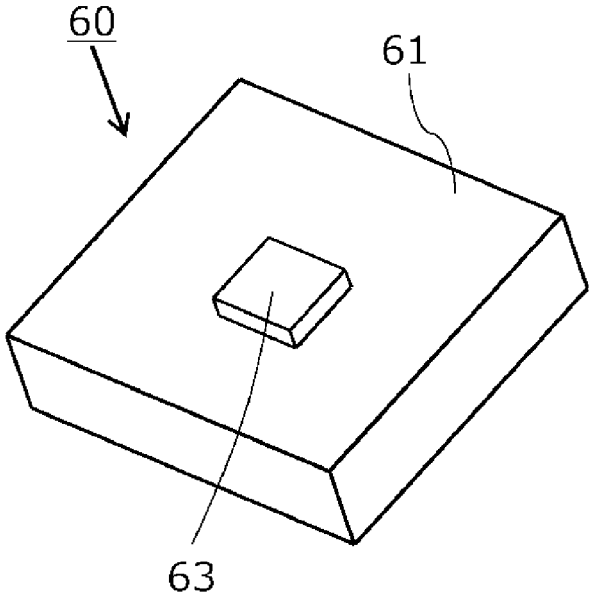
FIGS. 9A and 9B are schematic perspective views of a configuration of the storage member.
Figure 9B:
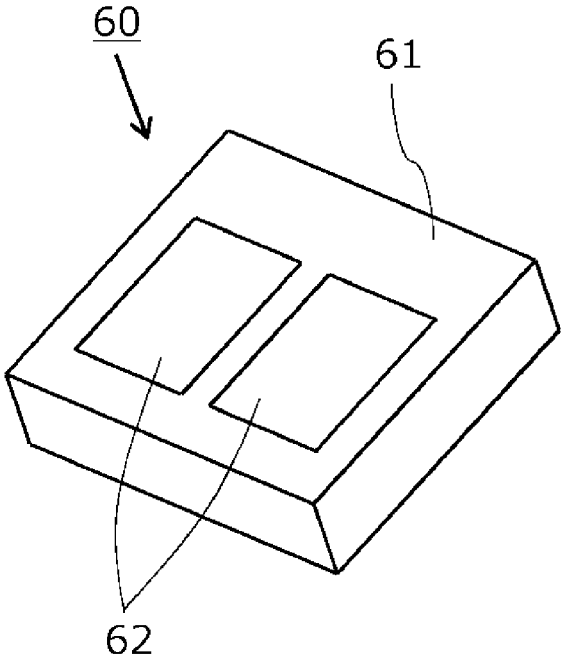

As illustrated in FIGS. 8A and 8B, in this embodiment, the first end member 38 includes a first attachment portion 38*c*. The first attachment portion 38*c* is located at the lower part of the first end member 38 in the state where the developing cartridge 4 is attached in the image forming apparatus 100. The storage member 60 is attached to the first attachment portion 38*c*. As illustrated in FIGS. 9A and 9B, the storage member 60 includes a substrate 61, a first electrode 62 and a first storage element 63 which stores the information. The first storage element 63 is a RAM or ROM, for example. As illustrated in FIG. 9A, the first storage element 63 is disposed on one side of the substrate 61. As illustrated in FIG. 9B, the first electrode 62, which is electrically connected to the first storage element 63, is disposed on the other side of the substrate 61. The side of the substrate 61 where the first storage element 63 is disposed may be covered with molded resin. If the first storage element 63 is covered with molded resin, the first storage element 63 is protected. The first storage element 63 may be disposed inside the storage member 60 in this way. The storage member 60 is a memory unit (first memory unit) in which the first electrode 62 and the first storage element 63 are integrated. The first storage element 63 is an example of the first storage element.

In the state where the developing cartridge 4 is attached in the main body of the image forming apparatus 100, the first electrode 62 of the storage member 60 contacts a main body electrode 65 disposed in the main body of the image forming apparatus 100. The first electrode 62 is electrically connected to the main body electrode 65 when the first electrode 62 and the main body electrode 65 are in contact. In this way, the first electrode 62 is an electrode (first electrode) that can contact and be electrically connected to the main body electrode 65.

In the first storage element 63, information of the developing cartridge 4 and information used for the image forming processing are stored. When the first electrode 62 is electrically connected to the main body electrode 65, communication is performed between the first storage element 63 and the control unit of the image forming apparatus 100. The control unit of the image forming apparatus 100 acquires information of the developing cartridge 4 from the first storage element 63, or writes information to the first storage element 63.

Figure 10A:
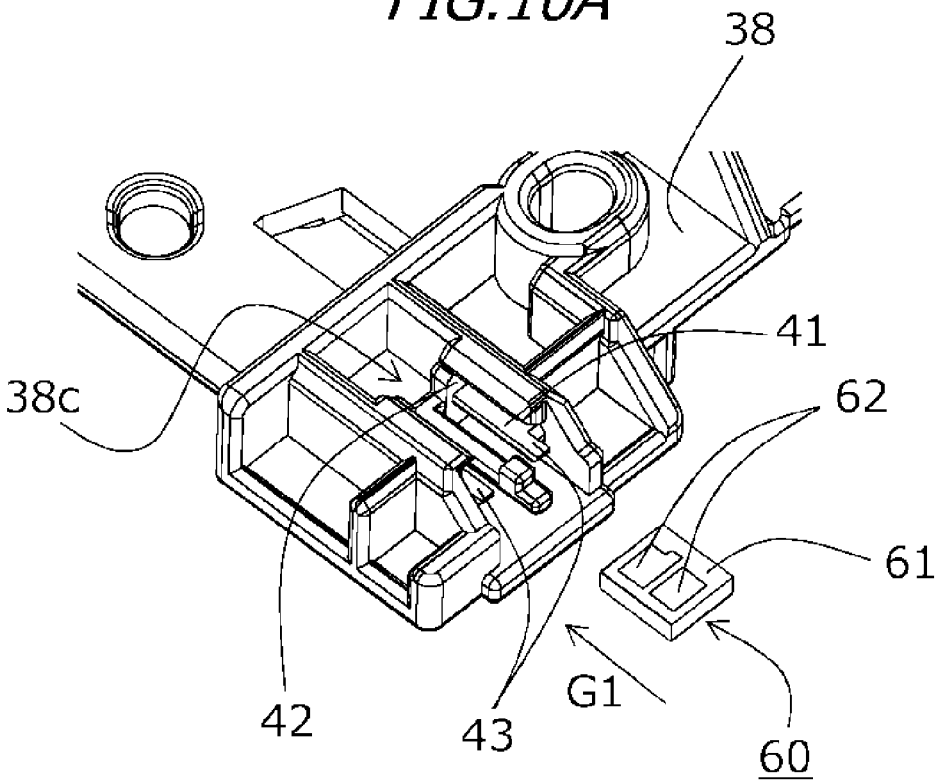
FIGS. 10A and 10B are diagrams depicting an attaching method of the storage member.
Figure 10B:
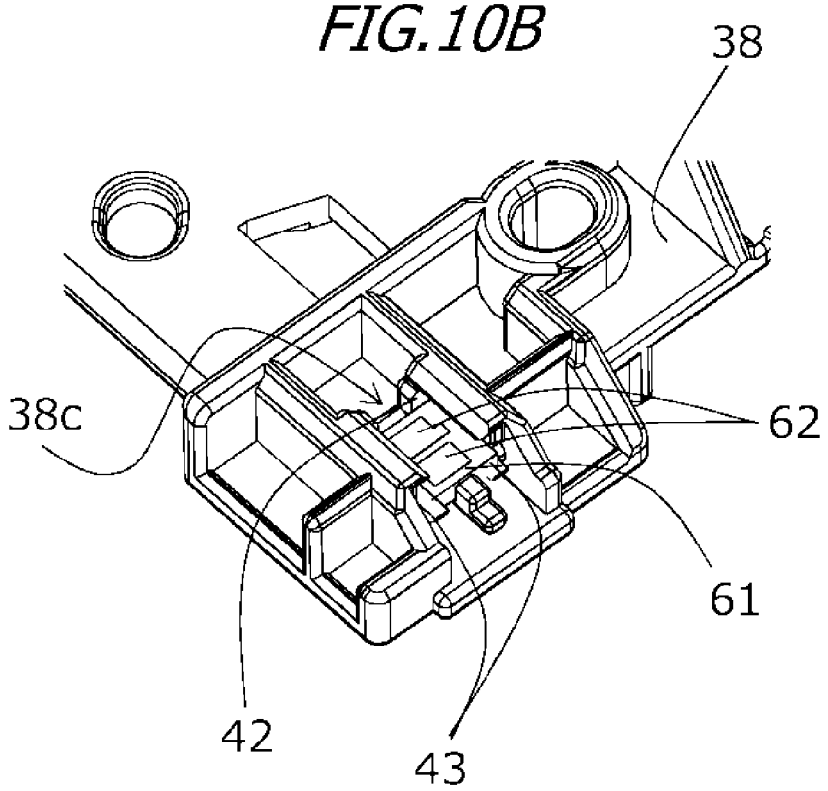

An attaching method (mounting method) of the storage member 60 to the developing cartridge 4 will be described. FIGS. 10A and 10B are diagrams depicting the attaching method of the storage member 60. FIG. 10A is a perspective view of the first end member 38 before attaching the storage member 60 to the developing cartridge 4. FIG. 10B is a perspective view of the first end member 38 after attaching the storage member 60 to the developing cartridge 4. The first attachment portion 38*c* of the first end member 38 has a slit portion (slit) 41 which is an opening to which the storage member 60 can be inserted.

As illustrated in FIG. 10A, the storage member 60 is inserted into the slit portion 41 formed in the first end member 38 in the arrow G1 direction. The storage member 60 thereby fits with the slit portion 41, and the attaching position of the storage member 60 is determined in a direction orthogonal to the inserting direction (arrow G1 direction) of the storage member 60. When the storage member 60 is inserted into the slit portion 41, the surface of the substrate 61, where the first electrode 62 is disposed (upper surface), is turned outward. In other words, the storage member 60 is inserted into the slit portion 41 in a state where the lower surface, which is on the opposite side of the upper surface, of the substrate 61, faces the first end member 38. The first electrode 62 is thereby exposed from the slit portion 41 in a state where the storage member 60 is inserted in the slit portion 41. This means that, as illustrated in FIG. 10B, the first electrode 62 exposed from the slit portion 41 can contact the main body electrode 65 in the state where the storage member 60 is fitted with the slit portion 41.

When the front edge of the storage member 60 contacts a contact portion 42 of the slit portion 41, the attaching position of the storage member 60 in the inserting direction (arrow G1 direction) of the storage member 60 is determined. In the state where the storage member 60 is fitted in the slit portion 41, melting ribs 43 disposed at the entrance of the slit portion 41 are heated and melted using ultrasonic welding. In the state where the melting ribs 43 are melted so as to prevent detachment of the storage member 60 from the developing cartridge 4, the melting portion (melting ribs 43 after melting) is cooled and solidified. Detachment of the storage member 60 from the developing cartridge 4 is thereby prevented.

Reproduction Method of Cartridge

The cartridge reproduction method will be described next.

The cartridge reproduction method according to this embodiment includes the following two steps, which will be described in sequence. Here a case of using the developing cartridge 4 as the cartridge will be described.

(1) Step of detaching storage member 60

(2) Step of attaching storage unit 80

(1) Step of Detaching Storage Member 60

Figure 11A:
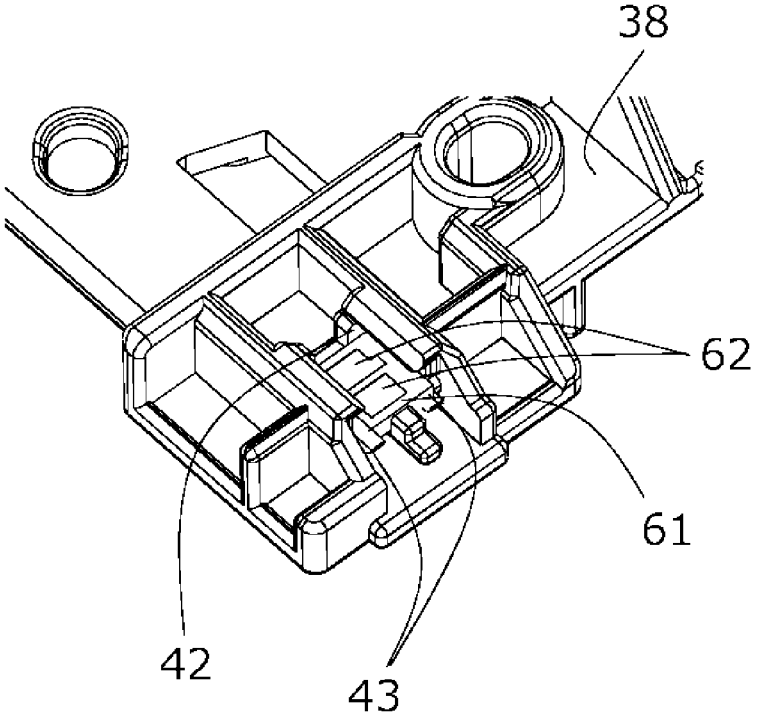
FIGS. 11A and 11B are diagrams depicting a step of detaching the storage member.
Figure 11B:
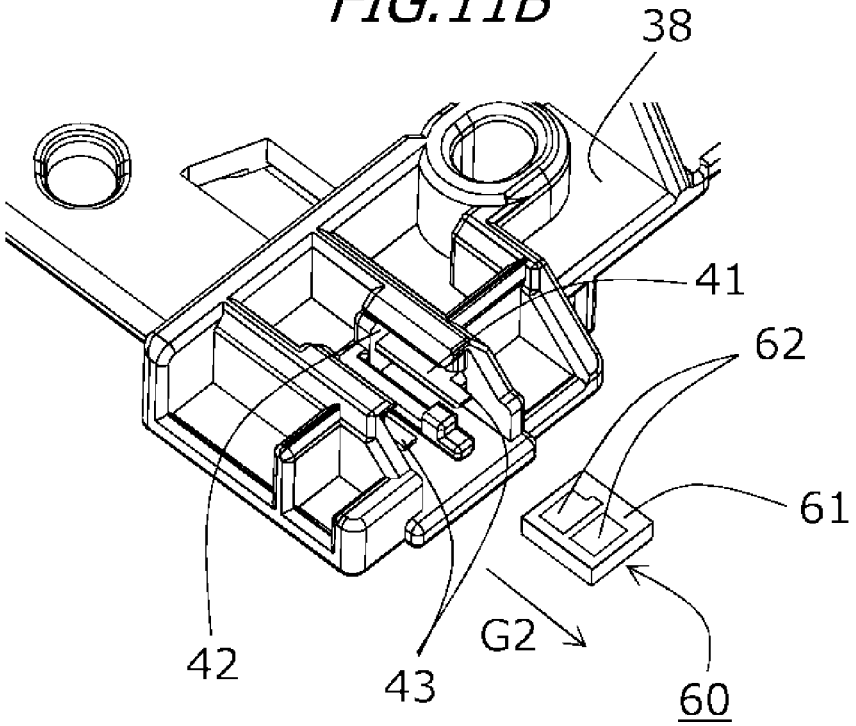

FIGS. 11A and 11B are diagrams depicting the step of detaching the storage member 60. FIG. 11A is a perspective view of the first end member 38 before detaching the storage member 60 from the developing cartridge 4. FIG. 11B is a perspective view of the first end member 38 after detaching the storage member 60 from the developing cartridge 4.

First a used developing cartridge (material cartridge, first cartridge) 4 is prepared. As illustrated in FIGS. 11A and 11B, the storage member 60 is detached from the slit portion 41 by pressing the end face of the storage member 60 in a direction (arrow G2 direction) that is opposite of the inserting direction of the storage member 60. At this time, the ribs, which are melted by heat-caulking (melting ribs 43 after melting) are broken. Burrs of the broken ribs are then removed, and the first end member 38 is cleaned by blowing.

(2) Step of Attaching Storage Unit 80

Configuration of Storage Unit

Figure 12:
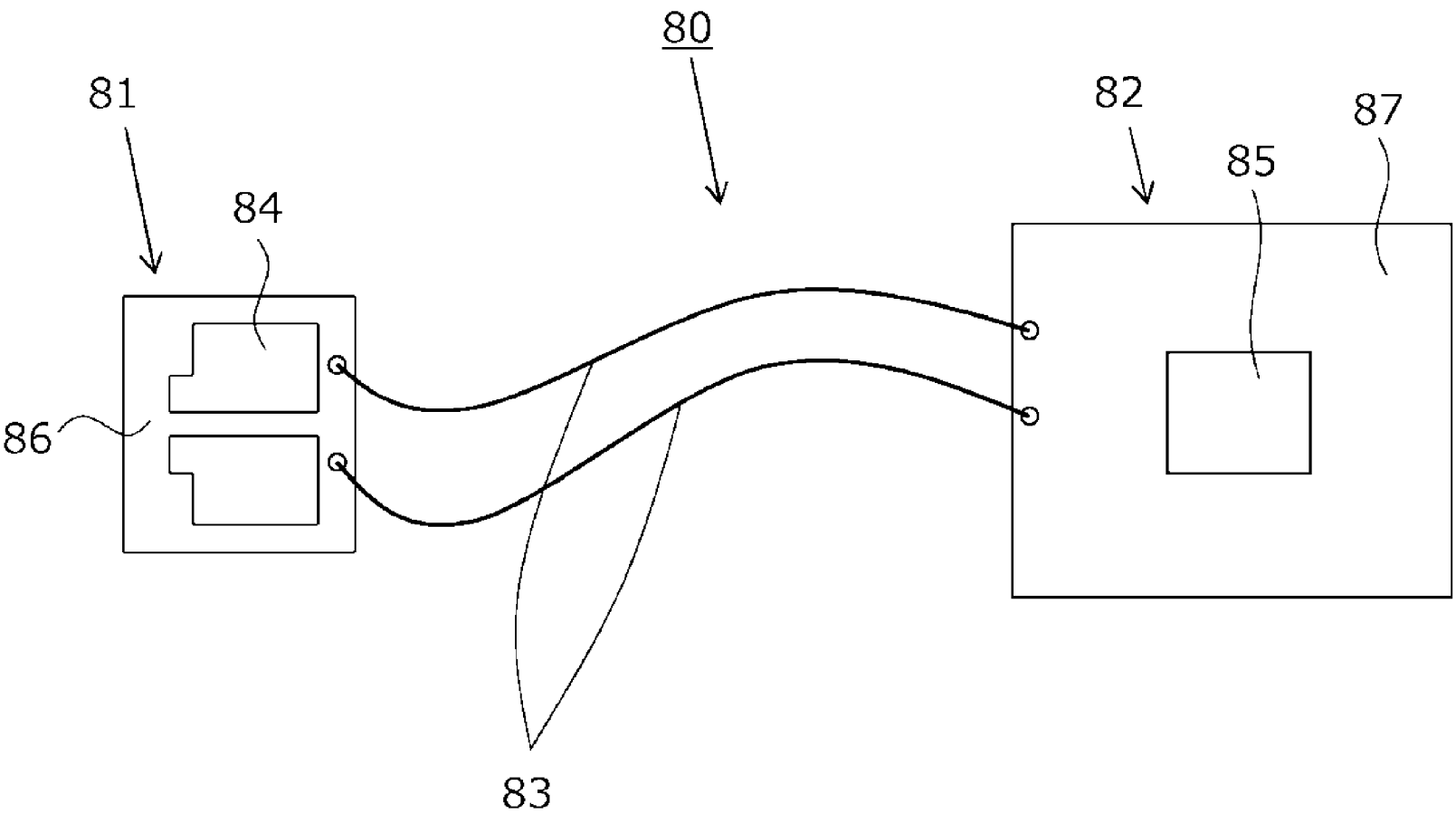
FIG. 12 is a schematic diagram depicting a configuration of a storage unit.

A configuration of a storage unit 80, which is replaced with the storage member 60 will be described with reference to FIG. 12. FIG. 12 is a schematic diagram depicting a configuration of the storage unit 80.

The storage unit 80 has an electrode unit 81 which includes a second electrode (cartridge electrode) 84 which can contact and be electrically connected to the main body electrode 65. The storage unit 80 has an element unit 82 which includes a second storage element 85 (e.g. RAM, ROM) to store information. The storage unit 80 includes a conductive path member 83 which electrically connects the electrode unit 81 and the element unit 82. The second electrode 84 and the second storage element 85 are electrically connected by the conductive path member 83.

In the storage unit 80, the electrode unit 81 and the element unit 82 are configured independently. The electrode unit 81 includes a substrate 86 and the second electrode 84 which is disposed on one side of the substrate 86.

The element unit 82 includes a substrate 87 and the second storage element 85 disposed on one side of the substrate 87. The second storage element 85 is a ROM or RAM, for example. The second storage element 85 stores information on the developing cartridge 4 and information used for the image forming processing. The side of the substrate 87 where the second storage element 85 is disposed may be covered with molded resin. If the second storage element 85 is covered with molded resin, the second storage element 85 is protected. The second storage element 85 may be disposed inside the element unit 82 like this.

The storage unit 80 is an example of the second memory unit. The electrode unit 81 is an example of the electrode unit. The conductive path member 83 is a conductive cable, for example. The conductive path member 83 is an example of the connecting member. The second electrode 84 is an example of the second electrode. The second storage element 85 is an example of the second storage element.

One end of the conductive path member 83 is fixed to the electrode unit 81 by solder, so that the conductive path member 83 is electrically connected to the second electrode 84 of the electrode unit 81. In the same manner, the other end of the conductive path member 83 is fixed to the element unit 82 by solder, so that the conductive path member 83 is electrically connected to the second storage element 85 of the element unit 82. By this configuration, the electrode unit 81 and the element unit 82 are connected via the conductive path member 83, and the second electrode 84 and the second storage element 85 are electrically connected. The conductive path member 83 has flexibility, and can be freely bent.

Attaching Method of Storage Unit

Figure 1B:
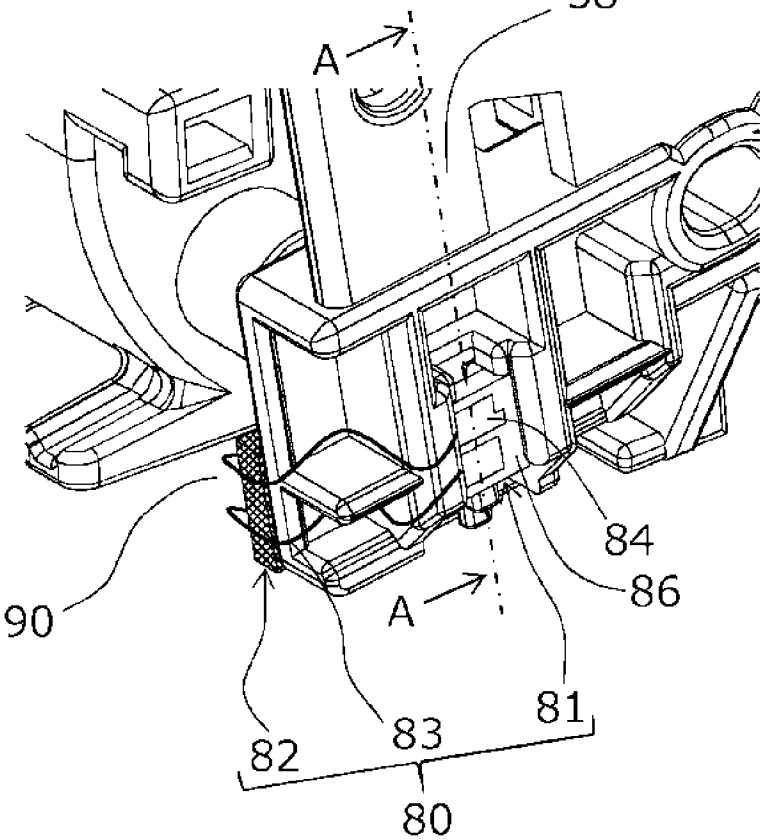
FIGS. 1A and 1B are schematic perspective views of an area around the attaching portion of a storage unit in a first end member.
Figure 1A:
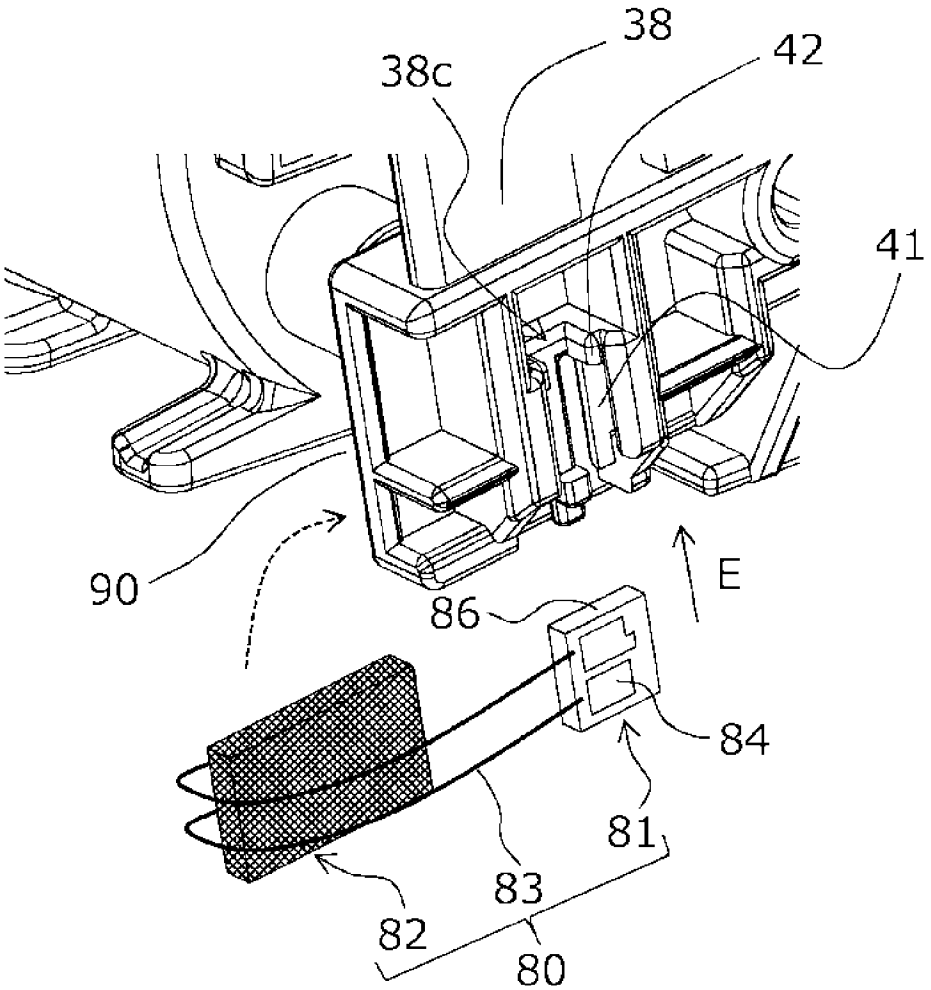

The method of attaching the storage unit 80 to the cartridge (developing cartridge 4) will be described next. FIGS. 1A and 1B are schematic perspective view of an area around the attachment portion of the storage unit 80 in the first end member 38. FIG. 1A is a perspective view of the first end member 38 before attaching the storage unit 80 to the developing cartridge 4. FIG. 1B is a perspective view of the first end member 38 after attaching the storage unit 80 to the developing cartridge 4.

As illustrated in FIG. 1A, the electrode unit 81 is attached to the first attachment portion 38*c* of the first end member 38 (step of attaching electrode unit). In concrete terms, the electrode unit 81 is inserted into the slit portion 41 formed in the first end member 38 in the arrow E direction. The electrode unit 81 thereby fits with the slit portion 41, and the attaching position of the electrode unit 81 is determined in a direction orthogonal to the inserting direction (arrow E direction) of the electrode unit 81. When the electrode unit 81 is inserted into the slit portion 41, the surface of the substrate 86 where the second electrode 84 is disposed (upper surface) is turned outward. In other words, the electrode unit 81 is inserted into the slit portion 41 in a state where the lower surface, which is on the opposite side of the upper surface, of the substrate 86 faces the first end member 38. The electrode unit 81 is thereby exposed from the slit portion 41 in the state where the electrode unit 81 is inserted into the slit portion 41. As a result, the second electrode 84 exposed from the slit portion 41 can contact the main body electrode 65 in the state where the electrode unit 81 is fitted with the slit portion 41.

When the front edge of the electrode unit 81 comes into contact with the contact portion 42 of the slit portion 41, the attaching position of the electrode unit 81 in the inserting direction (arrow E direction) of the electrode unit 81 is determined. As illustrated in FIG. 1B, in the state where the electrode unit 81 is fitted in the slit portion 41, the electrode unit 81 is fixed to the first end member 38 using adhesive or the like. Detachment of the electrode unit 81 from the developing cartridge 4 is thereby prevented. The element unit 82 may be attached to the first end member 38 after attaching the electrode unit 81 to the first end member 38, or the electrode unit 81 may be attached to the first end member 38 after the element unit 82 is attached to the first end member 38. Further, the conductive path member 83 may be attached to the electrode unit 81 and the element unit 82 after attaching at least one of: the electrode unit 81 and the element unit 82, to the first end member 38. In this case, the reproduction method of the developing cartridge 4 may be regarded as a method that includes the step of attaching the conductive path member 83.

The disposition and fixing method of the element unit 82 will be described next with reference to FIGS. 1A and 1B and FIG. 13. As illustrated in FIG. 1B, the electrode unit 81 is attached to the first end member 38, so as to be located outside the first end member 38 in the rotation axis direction of the developing roller 25. Here a gap 90 is formed between the first developing bearing 13 of the developing unit 39 and the first end member 38. The gap 90 is located at the inner side of the first end member 38 in the rotation axis direction of the developing roller 25. As illustrated in FIG. 1B, the element unit 82 is attached to the first end member 38, so as to be located in the gap 90. By disposing the element unit 82 in the gap 90, touching the element unit 82 by the user can be prevented. Further, no space is required to dispose the element unit 82 on the side where the electrode unit 81 is disposed.

The conductive path member 83 has flexibility, hence the conductive path member 83 can be folded back and disposed along the external portion of the first end member 38, as illustrated in FIG. 1B.

Figure 13:
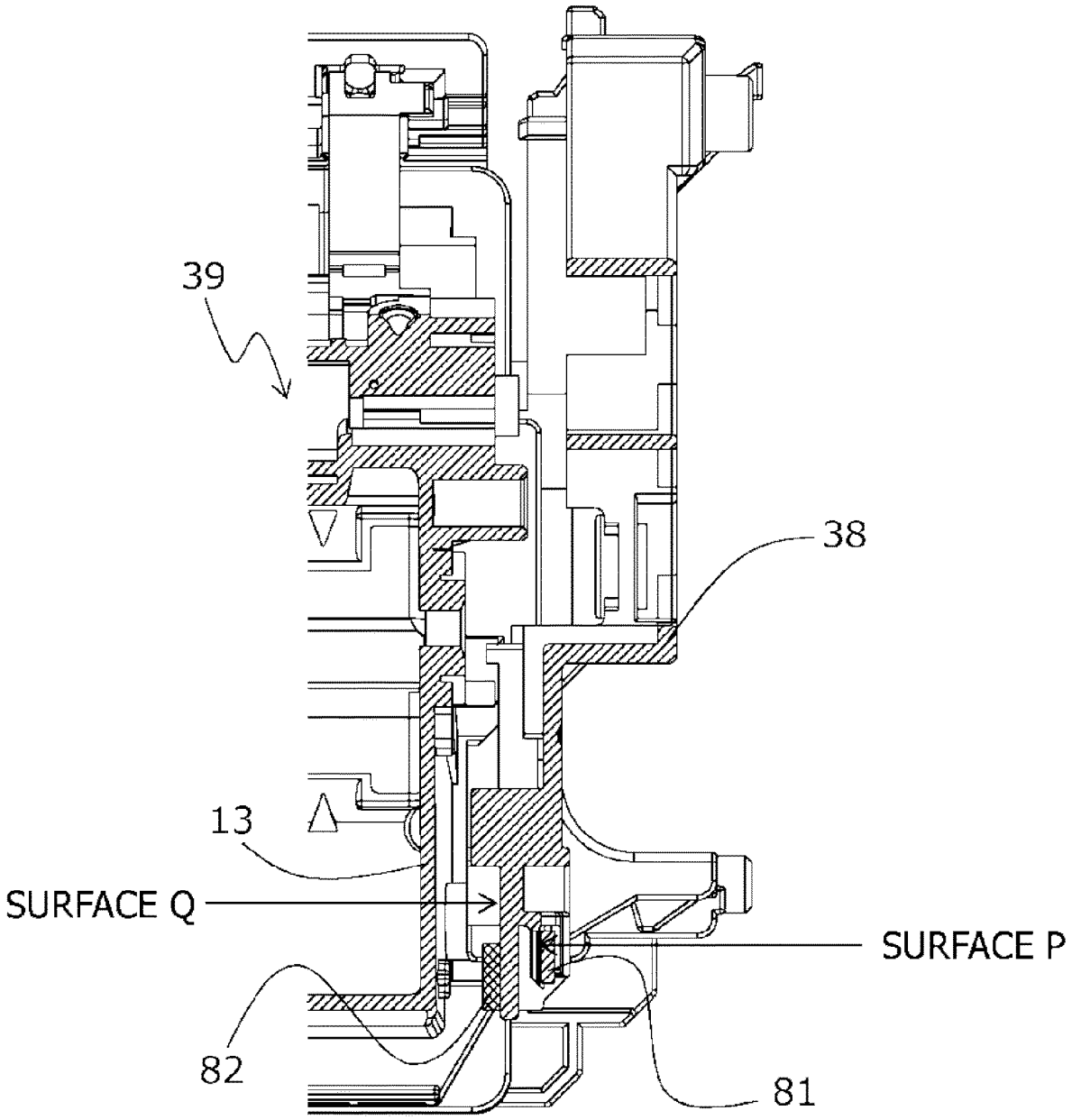
FIG. 13 is a schematic diagram depicting the disposition of the storage unit.

FIG. 13 is a schematic diagram depicting the disposition of the storage unit 80, and is an A-A cross-section of FIG. 1B. The element unit 82 is disposed on the rear surface (surface Q) of the first end member 38 where the electrode unit 81 is not disposed, and is fixed using adhesive or the like. The surface Q of the first end member 38 is a surface of the first end member 38 facing the first developing bearing 13. On the surface P, which is on the opposite side of the surface Q, of the first end member 38, the slit portion 41 is disposed, and the electrode unit 81 is attached to the slit portion 41. In the direction of the rotation axis Y (first direction), a part of the first end member 38 is disposed between the electrode unit 81 and the element unit 82.

In this embodiment, the element unit 82 is disposed on the rear side of the electrode unit 81. In other words, when viewing in the direction of the rotation axis Y, at least a part of the electrode unit 81 and at least a part of the element unit 82 overlap. This means that with respect to the direction crossing the direction of the rotation axis Y (first direction) of the first end member 38, the position of the electrode unit 81 and the position of the element unit 82 overlap.

In the case of the surface Q of the first end member 38, compared with the surface P of the first end member 38, securing an arrangement space is relatively easy, and a restriction in terms of shape is less so. In other words, in the surface P, a space to dispose an element unit 82 need not be secured if only a space to dispose the electrode unit 81 can be secured. This means that, compared with the case of disposing the element unit 82 and the electrode unit 81 on the same surface, the requirements on shape and size demanded for the storage unit 80 are relaxed. Therefore, the storage member 60, which is attached to the cartridge (developing cartridge 4) before reproduction, can be replaced with the storage unit 80, of which shape and size are different from the storage member 60. For example, even if the element unit 82 is larger than the slit portion 41, as in this embodiment, the element unit 82 can be attached.

When the developing cartridge 4, to which the storage unit 80 is attached, is inserted into the main body of the image forming apparatus 100, the second electrode 84 and the main body electrode 65 contact, whereby the second electrode 84 and the main body electrode 65 are electrically connected. Thus, the second electrode 84 is an electrode (second electrode) which can be contacted and electrically connected to the main body electrode 65. When the second electrode 84 is electrically connected to the main body electrode 65, communication is performed between the second storage element 85 of the element unit 82 and the control unit of the image forming apparatus 100. The control unit of the image forming apparatus 100 acquires information on the developing cartridge 4 from the second storage element 85, and writes information to the second storage element 85.

It is preferable that the shape and size of the electrode unit 81 are the same as the shape and size of the storage member 60. In the case where the shape and size of the electrode unit 81 are the same as the shape and size of the storage member 60, if the electrode unit 81 is inserted into the slit portion 41 and the front edge of the electrode unit 81 is contacted to the contact portion 42 of the slit portion 41, the attaching position of the electrode unit 81 is determined. In other words, the positional accuracy of the second electrode 84 of the electrode unit 81 and that of the first electrode 62 of the storage member 60 can be equalized. Thereby, when the developing cartridge 4 is inserted into the main body of the image forming apparatus 100, the second electrode 84 contacts the main body electrode 65 with certainty. However, the shape of the electrode unit 81 may be different from the shape of the storage member 60, or the size of the electrode unit 81 may be different form the size of the storage member 60. For example, if the electrode unit 81 is smaller than the storage member 60, the position of the second electrode 84, with respect to the developing cartridge 4, is adjusted after inserting the electrode unit 81 into the slit portion 41, then the electrode unit 81 is fixed to the first end member 38.

In the above description, the first attachment portion 38*c* of the first end member 38 includes the slit portion 41, and the storage member 60 is attached to the slit portion 41 of the first end member 38. The storage member 60 is then detached from the slit portion 41 of the first end member 38. Further, the electrode unit 81 is attached to the slit portion 41 of the first end member 38, and the element unit 82 is attached to the second attachment portion of the first end member 38, which is different from the slit portion 41 of the first end member 38. The present invention, however, is not limited to this, and the developing frame 31 may include the first attachment portion of the storage member 60, for example. The storage member 60 may be then detached from the first attachment portion of the developing frame 31, the electrode unit 81 may be attached to the first attachment portion of the developing frame 31, and the element unit 82 may be attached to the second attachment portion of the developing frame 31, which is different from the first attachment portion of the developing frame 31. In this case, the developing frame 31 corresponds to a part of the first unit, and the first end member 38 corresponds to the second unit.

In the above description, the step of detaching the storage member 60 from the developing cartridge 4, and the step of attaching the storage unit 80 to the developing cartridge 4 are described. However, the present invention may be applied to other cartridges (replacement components) that can be attached to and detached from the image forming apparatus 100. For example, the present invention may be applied to the toner cartridge to store toner, or the drum cartridge 9 which includes the photosensitive drum 1.

In this embodiment, the developing cartridge 4 and the drum cartridge 9 are independently attachable to and detachable from the image forming apparatus 100. However, the present invention may also be applied to a process cartridge which includes the photosensitive drum 1 and the developing roller 25. In this case, a member corresponding to the first end member 38 may include a photosensitive drum (second rotating member) 1 and a second frame to support the photosensitive drum 1, so that the photosensitive drum 1 can be rotated.

According to this invention, the first memory unit attached to the cartridge before reproduction can be replaced with the second memory unit of which shape and size are different from those of the first memory unit.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions. This application claims the benefit of Japanese Patent Application No. 2019-039739, filed on Mar. 5, 2019, which is hereby incorporated by reference herein in its entirety.

What is claimed is:

1. A cartridge reproduction method for reproducing a cartridge from a material cartridge that is attachable to and detachable from an image forming apparatus including a main body electrode, wherein the material cartridge includes:

a first unit including a first attachment portion;

a first memory unit attached to the first attachment portion, the first memory unit including a first electrode and a first storage element for storing information, the first electrode configured to be brought into contact with the main body electrode so as to be electrically connected to the main body electrode, and the first storage element being electrically connected to the first electrode; and a second unit that is joined to the first unit, the cartridge reproduction method comprising:

detaching the first memory unit from the first attachment portion;

attaching an electrode unit to the first attachment portion, the electrode unit including a second electrode, the second electrode configured to be brought into contact with the main body electrode so as to be electrically connected to the main body electrode; and attaching an element unit including a second storage element for storing information to the first unit so that the element unit is located in a gap formed between the first unit and the second unit, wherein the second electrode and the second storage element-being are electrically connected via a connecting member.

2. The cartridge reproduction method according to claim 1, wherein the connecting member is flexible.

3. The cartridge reproduction method according to claim 1, wherein the first attachment portion includes a slit to which the first memory unit is insertable, and wherein the electrode unit is inserted into the slit.

4. The cartridge reproduction method according to claim 3, wherein the element unit is larger than the slit.

5. The cartridge reproduction method according to claim 1, wherein the second unit is rotatable around a unit axis relative to the first unit.

6. The cartridge reproduction method according to claim 5, wherein a position of the element unit and a position of the electrode unit overlap with respect to a direction crossing a direction of the unit axis.

7. The cartridge reproduction method according to claim 5, wherein the second unit includes a first rotating member, and a first frame that supports the first rotating member so that the first rotating member is rotatable.

8. The cartridge reproduction method according to claim 7, wherein the first unit includes an end member that supports an end of the second unit in a rotation axis direction of the first rotating member.

9. The cartridge reproduction method according to claim 7, wherein the first unit includes a second rotating member, and a second frame that supports the second rotating member so that the second rotating member is rotatable.

10. The cartridge reproduction method according to claim 7, wherein the first rotating member is a developer bearing member that bears a developer.

11. The cartridge reproduction method according to claim 1, further comprising attaching the connecting member.

12. A cartridge that is attachable to and detachable from an image forming apparatus including a main body electrode, the cartridge comprising:

a first unit including a first attachment portion;

a second unit that is joined to the first unit;

an electrode unit attached to the first attachment portion and including a cartridge electrode, the cartridge electrode configured to be brought into contact with the main body electrode so as to be electrically connected to the main body electrode; and an element unit including a storage element, the storage element electrically connected to the cartridge electrode, wherein the element unit is attached to the first unit so as to be located in a gap formed between the first unit and the second unit.

13. The cartridge according to claim 12, wherein the first attachment portion includes a slit, and wherein the electrode unit is inserted into the slit.

14. The cartridge according to claim 13, wherein the element unit is larger than the slit.

15. The cartridge according to claim 12, wherein the second unit is rotatable around a unit axis relative to the first unit.

16. The cartridge according to claim 15, wherein a position of the element unit and a position of the electrode unit overlap with respect to a direction crossing a direction of the unit axis.

17. The cartridge according to claim 15, wherein the second unit includes a first rotating member, and a first frame that supports the first rotating member so that the first rotating member is rotatable.

18. The cartridge according to claim 17, wherein the first unit includes an end member that supports an end of the second unit in a rotation axis direction of the first rotating member.

19. The cartridge according to claim 17, wherein the first unit includes a second rotating member, and a second frame that supports the second rotating member so that the second rotating member is rotatable.

20. The cartridge according to claim 17, wherein the first rotating member is a developer bearing member that bears developer.

* * * * *